United States Patent [19]

Dumbeck et al.

[11] 4,404,640

[45] Sep. 13, 1983

[54] GRINDING MILL MONITORING INSTRUMENTATION

[75] Inventors: Robert F. Dumbeck, Elgin; Phillip W. Welch, Houston, both of Tex.

[73] Assignee: W. R. Grace & Co., Cambridge, Mass.

[21] Appl. No.: 238,710

[22] Filed: Feb. 27, 1981

Related U.S. Application Data

[63] Continuation-in-part of Ser. No. 223,833, Jan. 9, 1981.

[51] Int. Cl.[3] ..... B02C 25/00

[52] U.S. Cl. ..... 364/551; 364/468; 364/483; 241/34

[58] Field of Search ..... 364/551, 468, 469, 483; 241/24, 26, 30, 33, 34, 35

[56] References Cited

U.S. PATENT DOCUMENTS

| | | | |
|---|---|---|---|
| 2,405,059 | 7/1946 | Sahmel | 241/33 |
| 2,766,941 | 10/1956 | Weston | 241/30 |
| 3,783,252 | 1/1974 | Putman | 241/34 X |
| 3,839,628 | 10/1974 | Higgins et al. | 364/551 |
| 3,860,804 | 1/1975 | Rutman | 241/34 X |
| 3,904,857 | 9/1975 | Sandblom | 364/468 X |
| 3,944,146 | 3/1976 | Stockmann et al. | 241/30 |
| 3,988,578 | 10/1976 | Weber | 364/475 |
| 4,026,479 | 5/1977 | Bradburn et al. | 241/30 |
| 4,212,429 | 7/1980 | Cuvelier et al. | 241/26 |
| 4,281,800 | 8/1981 | Flavel | 241/34 X |
| 4,294,412 | 10/1981 | Bohlin et al. | 241/33 X |

FOREIGN PATENT DOCUMENTS

| | | |
|---|---|---|
| 576472 | 4/1946 | United Kingdom . |
| 630980 | 10/1949 | United Kingdom . |
| 1291691 | 10/1972 | United Kingdom . |
| 1328939 | 9/1973 | United Kingdom . |
| 1351387 | 4/1974 | United Kingdom . |
| 1401113 | 7/1975 | United Kingdom . |

*Primary Examiner*—Edward J. Wise
*Attorney, Agent, or Firm*—Laurence R. Brown

[57] ABSTRACT

A current transformer is coupled about the power feed line of the motor operating a ball mill grinder or the like to sense the motor current. This current is converted to a motor load or horsepower signal which is processed together with mill flow rate information of both raw materials and additives such as chemicals for improving grinding efficiency. Thus, signals representative of mill operating efficiency are derived, and displayed in visual form having a relationship to internal mill conditions and optimum mill operating efficiency. Also the sampled signals are sampled and stored in digital form in a computer memory and in a tape recorder for processing and recall. The samples are identified by a recorded time signal.

18 Claims, 3 Drawing Figures

GRINDING MILL MONITORING INSTRUMENTATION

This is a continuation-in-part of the copending application of Phillip W. Welch and Lawrence R. Roberts entitled METHODS OF OPERATING BALL GRINDING MILLS, filed Jan. 9, 1981, Ser. No. 223,833.

TECHNICAL FIELD

This invention relates to mills such as ball mills used for grinding, and more particularly it relates to instrumentation monitoring the operation of such mills.

BACKGROUND ART

In grinding mills such as ball mills, the operation is monitored and/or controlled in the prior art by instrumentation primarily solely by sensing the sound of the mill, as exemplified in U.S. patents, as follows:

V. Sahmel—U.S. Pat. No. 2,405,059—July 30, 1946

D. Weston—U.S. Pat. No. 2,766,941—Oct. 16, 1956

H. Stockmann et al.—U.S. Pat. No. 3,944,146—Mar. 16, 1976.

In these patents, a single signal is monitored for processing. However, in R. Bradburn et al.—U.S. Pat. No. 4,026,479—May 31, 1977, a computer processes signals from several sources to optimize performance in a complex system of ore grinders with a water feed system.

Some of the conditions measured to effect controls are sound in two concurrently operating mills, level of materials being pumped, and cyclone overflow particle size and density. Both water and ore feed are controlled by the computed result from the monitored conditions, such as a comparison of the feed with the rod-mill sound in a matrix memory to determine when an overload or underload condition exists.

While the foregoing equipment can in an elementary way sense certain mill conditions and control flow of materials to improve performance, there is no ability of the equipment to show relatively unskilled operators the mill conditions to create an understanding of the reactions of different raw materials, additives, etc. passing through the mill. Nor has there been provided any historical record of the mill operation for analysis of past mill conditions.

Furthermore, all the prior art instrumentation is devoid of a realistic relationship to the mill internal operational efficiency which seriously affects operating conditions particularly when variable conditions exist affecting flow, grinding or output product characteristics such as with the use of additive chemicals.

In addition, it is not known in the prior art how to provide universally useful instrumentation that may be employed at a variety of different mills without special tailoring or custom installation and fitting to meet the different mill conditions.

Also the use of sound signals is restrictive not only to particular mill conditions which change with material content being ground, etc., but it also is subject to environmental noise, mill location, etc., all of which can lead to problems of interpretation of signal meaning. A much more reliable signal source is desirable for adequate monitoring or control of mill conditions.

Accordingly, it is an objective of this invention to provide improved instrumentation of a type that can not only be adapted simply to a variety of different mill conditions, but which will provide a historical record of mill operation and a video display panel that will enable an unskilled operator to understand the milling process and to run the mill at optimum production levels.

Other objectives, features and advantages of the invention will be found throughout the following description, drawing and claims.

DISCLOSURE OF THE INVENTION

A digital computer processes various ball mill operating conditions and derives therefrom signals for operating video displays showing internal mill operation conditions and on-line efficiency. Also the computer stores the signals for recall of historical data. Thus, the on-line signals are sampled periodically and identified with a clock time address for storage in the computer memory and for readout into an auxiliary tape recorder for long term historical review of mill operation. The recorded signals are recalled and viewed in fast readout mode on the video displays when desired. The instrument provided is universally adaptable by coupling means comprising an a-c transformer that couples to the electric motor feed line to monitor motor current which changes as a function of load, and thus can be expressed in terms of horsepower. The adaptability of the computer then will permit the monitored signals to be normalized for different mill capacities and conditions without custom tailoring of the instrumentation or sensing equipment.

Also provided for processing in the computer are signals indicative of the flow rate through the mill and provision is made for analysis of conditions resulting in optimum efficiency in response to the addition of chemicals affecting grinding efficiency.

Thus, real time and historical signals are available for visual monitoring so that unskilled operators can understand the operating conditions and keep a mill operational at high efficiencies.

Only the basic motor power variable signal is necessary and used for indicating the instantaneous mill condition within the grinder both as a matter of flow characteristics through the grinder and the grinding profile indicative of the status of grinding media within the mill. Other semivariable or long term variable data can be entered under different mill conditions by keyboard.

THE PREFERRED EMBODIMENT

Figure 1A:
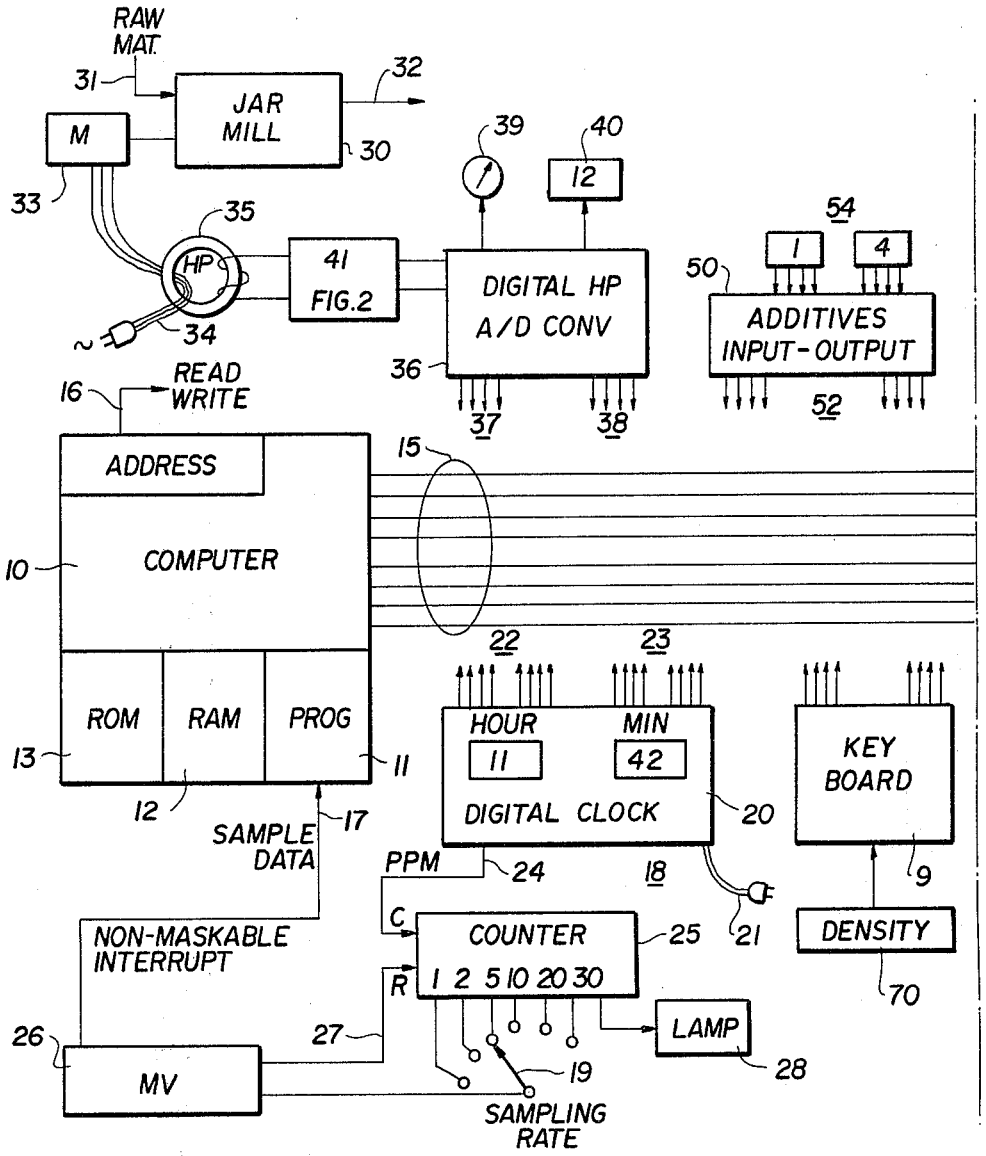
FIG. 1 is a block schematic drawing of the instrumentation system provided by this invention.
Figure 1B:
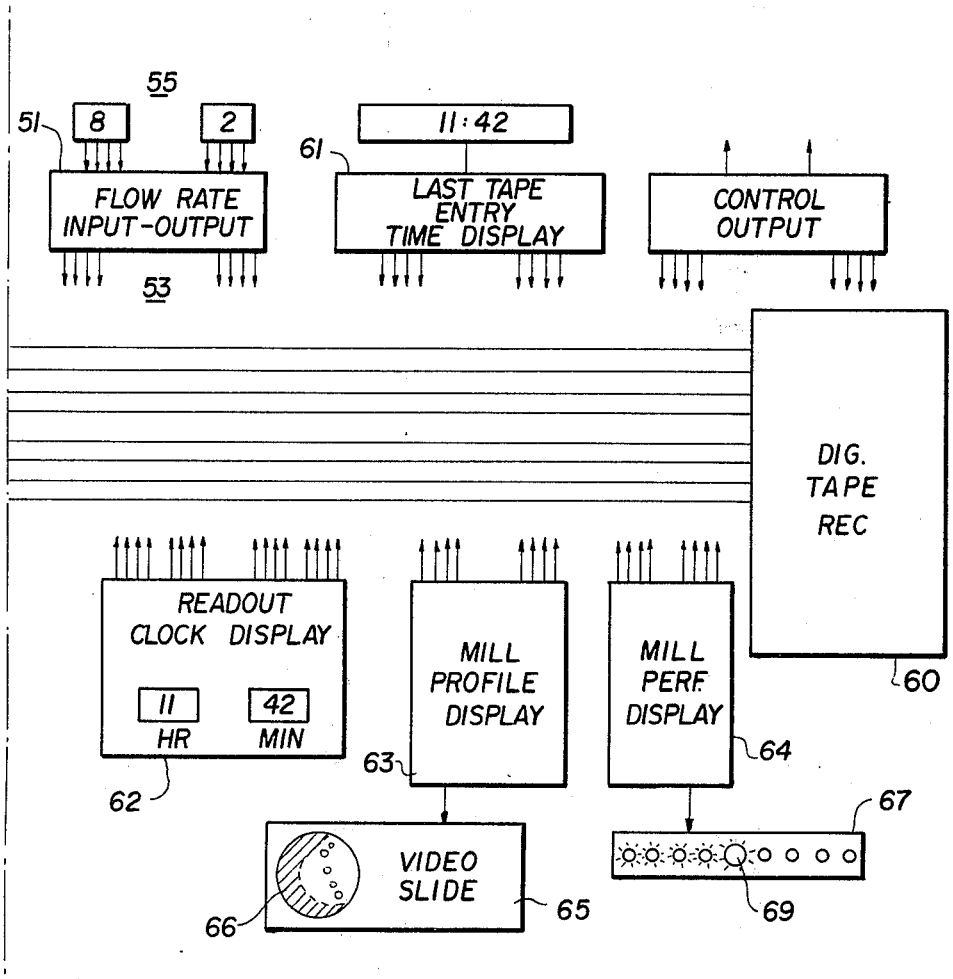

As may be seen in FIG. 1, a programmable microprocessor computer 10 is provided with internal program 11 and memory capacity such as random access memory 12 and read only memory 13. Various types are available, but a "Motorola" Model 6800 is well adapted for this service.

Such a computer may communicate on the eight-bit lines 15 to receive or release data under control of the computer program. Each data unit processing signals into or out of the computer has a control address line (not shown) which is operable from the computer in either read or write mode as indicated by line 16.

The computer also has the capability to defer its internal program and give priority to receipt of input data whenever a non-maskable interrupt signal is received, at line 17. This permits the computer to sample and store data at sampling times determined by the clock section 18, and selected at times typically 1, 2, 5, 10, 20 or 30 minute intervals by means of sampling rate switch 19.

The system clock is a real time digital clock 20 operable in synchronism with the a-c power 21, for example. With the system using binary coded decimal data therefore, four data lines exist for each decimal digit, and two decimal digits may be processed on the eight-bit computer bus 15, such as the two hour decimal digits or the two minute decimal digits respectively provided at lines 22, 23. To avoid drawing complexity, the connections between the eight digit lines and eight computer bus lines 15 are omitted.

Thus, typically to read the real clock time of any sample of data from the system, the computer is programmed to address and read the clock hours and then to address and read the clock minutes into a suitable memory location corresponding to the entry of the sampled data. The sampled data is then read from an appropriate addressed unit or sequence thereof into the computer.

This sampled information is available for computation and processing by appropriate computer subroutines programmed to provide it in proper form for storage readout and/or display purposes.

The sampling rate signal is provided by way of an appropriate pulse such as one every minute (ppm) derived at lead 24 from digital clock 20, which is then processed by counter 25 to provide an output pulse at a selected count (1, 5, etc.). This pulse is shaped in multivibrator 26 and used to reset counter 25 at lead 27 and provide the interrupt signal at lead 17. If desired a lamp 28 may also be pulsed at the sampling time.

The system monitors the operation of jar mill 30 which is typically a ball mill grinding clinkers inserted at 31 to produce cement output at 32. The mill is driven by synchronous electric motor 33 from a power input line 34. Thus, the current flow in power input line 34 is a function of mill load (horsepower) and changes as the load of material flow through the mill changes. Accordingly, an a-c coupled transformer 35 may simply be used universally with any mill to provide input load data without mill modification, custom tailoring or installation of any kind. The transformer is simply a-c coupled to line current such as by surrounding the line with a transformer core.

For processing in the computer 10, the current signal derived at transformer 35 is converted to digital form in analog to digital converter 36 to provide two decimal digits 37, 38 representative of magnitude. Typically the current changes substantially linearly with horsepower over the load operating range and provides a signal magnitude variation range of twenty milliamperes. A meter 39 or digital display 40 may be used to visually monitor horsepower if desired. It is seen therefore that the horsepower may be sampled and read into computer 10 whenever addressed by lead 16 as programmed by the computer.

A critical part of this invention requires detection and handling of small magnitude signals accurately portraying the load horsepower. The power line 34 carries many amperes and this change is small, but is readily processed as taught by this invention. Thus, the signal processing circuit 41 is shown in more detail in FIG. 2. It suffices to state that it has been determined that a properly loaded synchronous motor 33 will produce a substantially linear change of current over a load range including the optimum load. Thus, will overload or underload can be determined from motor current magnitude alone. The magnitude and effect of the overload or underload is hereinafter more fully set forth. Simply stated the transformer coupling to the power line provides a way to handle the small magnitude dynamic current changes reliably and accurately while ignoring the large magnitude motor current.

Figure 2:
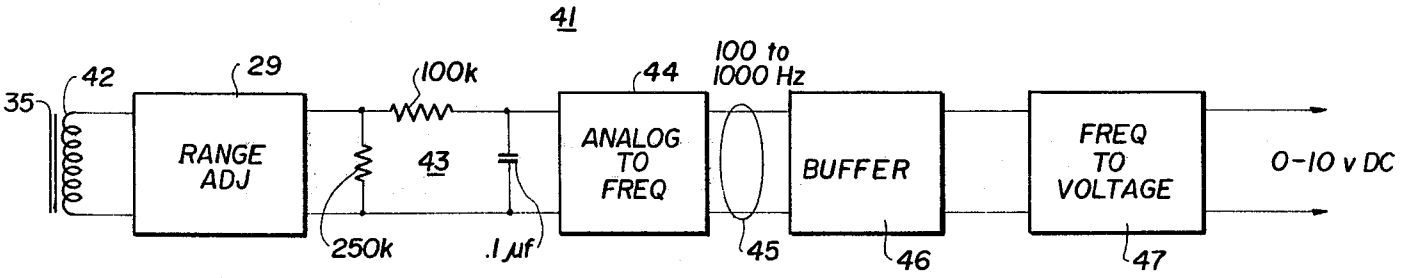
FIG. 2 is a schematic diagram partially in block form of mill load sensing and signal processing circuits afforded by this invention.

As seen in FIG. 2, a typical range of 0–50 mv a-c to 0–1 v a-c signal is provided at transformer 35 output winding 42. To adapt to different installations, current normalization expander-compressor-attenuator standardizing means 29 may be provided. Thus a resulting variable current signal of several milliamperes magnitude is processed through filter network 43 and converted to a variable frequency signal in converter 44. Thus, the output frequency range of 100 to 1000 hertz at leads 45 is readily attainable with standard integrated circuit chip-converter units. An isolation or buffer circuit 46 such as a standard photo-isolation element is then used to transfer the signal into the standard frequency to voltage circuit chip 47 for an output range of zero to ten volts, which is readily processed by any standard analog to digital converter (36, FIG. 1) to provide a two digit accuracy signal over the desired range.

Other mill inputs are processed concurrently with the load signal (37, 38) in the computer program. Significant such inputs are those for additives 50 and the flow rate 51 through the mill. These signals may be sensed on-line by appropriate instruments and programmed for entry or entered manually by an operator from a computer keyboard 9, which can address the computer for programming or entry of data. Thus, semi-variable data may be treated as the mill conditions change or as the flow of additives and/or raw material clinkers is varied. These other inputs may take various forms, but typically the additives may be introduced as a weight or a percentage of the load 52 and the flow rate 53 may be introduced as pounds per minute per cubic foot to two digit accuracy. These may be entered manually at switch sets 54 or 55, for example. The sampling of this data proceeds as aforesaid under program of the computer via lead 16, and is appropriately stored and processed in computer 10.

It is clear, however, that the signal data relating to mill performance may be derived in different form directly from on-line sensing equipment, and computations on such data can be programmed for the computer.

To supplement computer memory 12 for long term storage of historical data, the tape cassette recorder 60 is coupled to the computer bus 15 for addressing by the computer (16) in read and write modes as directed by computer subroutine programming. Thus, whenever desired a playback of the former day's mill run may be initiated.

This cassette recorder for example may be the computer interface recorder SPEC. 0075 available from Braemar Computer Devices, Inc., Burnsville, Minn. It is to be recognized that the entire instrumentation of FIG. 1 may be assembled in a portable hand carried unit which can simply be coupled to any existing jar mill 30 by means of transformer coupler unit 35 and used for analysis and monitoring either temporarily or permanently.

In order to identify the cassette recorded information, the time address of the last recorded tape entry is displayed by digital display-register assembly 61. This information is read into the computer from register 61 by means of computer program instructions addressing the register via load 16, in the same manner aforesaid.

A further clock display register 62 is similarly actuated with the time address of any monitored data displayed visually by the mill profile display means 63 or the mill performance display means 64. These display means respectively convert to visual form two different kinds eight bit words (or sequential words) on bus 15 derived by computer computation from sampled input data on lines 37, 38, 52 and 53 (or other inputs as desired).

The video slide or picture selector device 65 thus projects for each range of load conditions a different profile view 66 of interior conditions within the mill 30, which represents the existing ball-load configuration. This is a function of mill load and thus current magnitude from the AD converter register 36. The mill performance display 67 comprises a line of lights with an optimum center light condition. The lights are lighted in succession from left to right to indicate whether the mill performance is below, at, or above optimum operating throughput for most efficient operation under the parameters being processed. Thus, at different mill loads (37, 38) the flowthrough rate changes and the computer will determine under such changed conditions the lights of array 67. Essentially this corresponds to the flow pattern within the jar mill in response to the receipt of input clinkers at lead 31, where in the desired sense turbulence extends a known distance along the length of the mill 30.

The computer 10 is programmed to compile the data and to make a corresponding selection of the lights to be lighted in each display panel from the appropriate available input information. Thus, essentially motor power at 37, 38 tells by load what the inner turbulence pattern is, and the flow rate entry 53 will adjust the row of lamps 67 to determine the center lamp position at which the mill is preferably operated.

Figure 3:
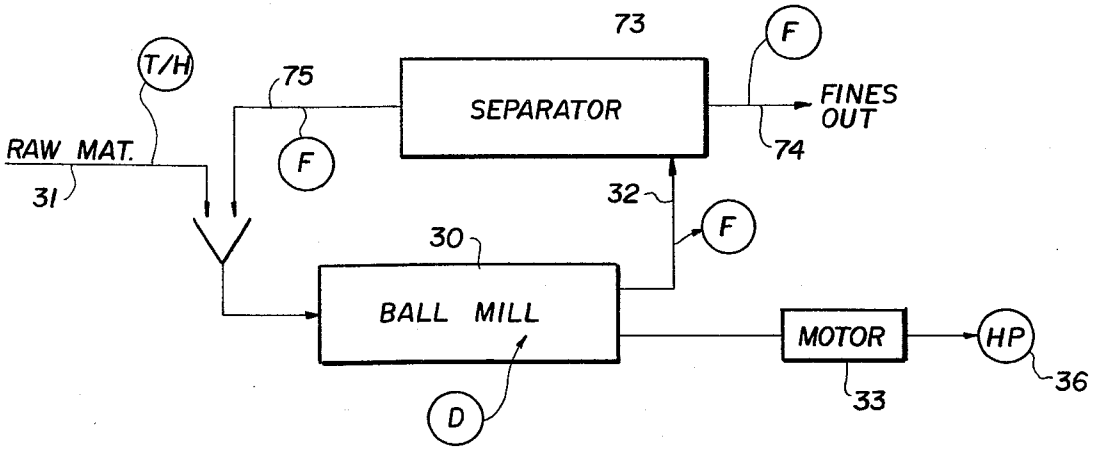
FIG. 3 is a flow diagram of a typical ball mill installation showing conditions monitored in accordance with the teachings of this invention.

In order to understand how this instrumentation provides a monitoring capability displaying and affecting the operating efficiency of the mill system reference is made to FIG. 3 and corresponding theory of mill operation. Thus, the conventional mill provides a ball mill 30 with electric drive motor 33 for grinding clinkers as raw materials passing from input line 31 through the mill to output line 32. Then the separator 73 separates fines available at line 74 and recirculates the coarser materials through line 75.

This process may be monitored by a set of sensors or meters as follows:

(a) means F sensing the fineness of the materials ground at line 32, the fines out at line 74 and the recirculated tailings at line 74 in terms such as weight in grams of a predetermined volume of the materials (400 ml), (b) means sensing the ball mill throughput or mill production rate in tons per hour (T/H) simply derived at input lead 31, (c) means 36 sensing the motor horsepower (HP) as hereinbefore described, and (d) means D sensing the density (or Void) of material being processed in the mill which is a function of mill volume and the clinker density.

Such information therefore gives parameters that can be used in calculating the operating flow rate (FR) of the mill in pounds per minute per cubic foot. FR can be expressed as a function of the mill dimensions, the throughput (T/H), the circulating load as represented by the fineness measures (F), and the characteristics of the clinker in terms of the density (D).

The following data may be used in calculating the flow rate (FR) and other mill operational characteristics.

| | Abbreviations |
|---|---|
| BASIC MILL INFORMATION: | |
| Effect Mill Diameter (feet)* | DIAM |
| Effective Mill Length (feet)* | LONG |
| Weight Grinding Media (pounds) | GMWT |
| Volume Loading of Grinding Media (percent)** | % VL |
| Mill Production Rate (tons per hour) | TPH |
| OPERATIONS DATA: | |
| Mill Retention Time (minutes) | MRT |
| Fineness Fines (grams) | FINE |
| Fineness Feed (grams) | FEED |
| Fineness Tail (grams) | TAIL |
| Bulk Density - Separator Feed (pounds/cu.ft.) | BKDN |
| CALCULATED DATA: | |
| Circulating Load (%) | % CL |
| Instantaneous Clinker Charge (pounds) | ICC |
| Bulk Volume Clinker (cubic feet) | BVC |
| Steel to Clinker Ratio (pound to pound) | S/C |
| Volume of Grinding Media (cubic foot) | GMFT |
| Grinding Media Density (pounds/cu.ft.) | GMDN |
| Porosity of Grinding Media (percent void space) | % POR |
| Volume of Void Space in Grinding Media (cubic feet) | VOID |
| Void Fill (percent) | % VF |

FORMULAS:

$$BKDN = (0.156)\ FEED$$

$$\%\ C/L = \frac{(FINE\text{-}FEED)}{(FEED\text{-}TAIL)} \cdot (100\%)$$

$$ICC = (\tfrac{1}{3})\ (MRT)\ (TPH)\ (\%\ C/L + 100)$$

$$BVC = ICC \div BKDN$$

$$S/C\ Ratio = GMWT \div ICC$$

$$GMFT = (0.00\ 7854)\ (DIAM)^2\ (LONG)\ (\%\ VL)$$

$$GMDN = GMWT \div GMFT$$

$$\%\ POR = \frac{(490 - GMDN)}{490}\ (100\%)$$

$$VOID = (\%\ POR)\ (GMFT) \div 100$$

$$\%\ VF = \frac{BVC}{VOID} \cdot (100\%)$$

$$FR = (\tfrac{1}{3})\ (TPH)\ (\%\ C/L + 100) \div VOID$$

*Disregard mill manufacturers nominal designations suc as 11 × 32 and use inside liners' I.D. and compartment lengths exclusive of unused partition space.

**Measure chord length and grinding media depth after thorough grind out. Volume loading is calculated geometrically as per cent of cross sectional area.

Thus, this particular flow rate as established may be entered at lines 53 into the computer, or more elementary sensed data may be entered and calculated as a part of the programmed computer operation to produce the flow rate figure. Other flow rate data may be used as desired to give with the mill load data (HP) an interrelated and meaningful indication of mill performance.

Similarly the additives may be entered as gallons of grinding aid and may be related to mill performance in analysis of the effect on fines and circulating load, or more simply on mill horsepower. This will enable unskilled operating personnel to optimize the addition of chemicals for any given set of mill conditions.

In summary, the video slide conditions 66 are displayed as a function of load on the mill as one indication of mill efficiency. The displayed profile represents the relationship of grinding media and mill charge of clinkers to the rotating drum as an effective average or integration of conditions prevailing throughout the drum length. Thus, it can be immediately seen whether the mill is underloaded or overloaded with the charge. The mill performance meter (which could also be a normalized center scale meter if not digitized) also provides an instantaneous indication of the desired flow of materials compared with the optimum at the state of the existing parameters of mill operation. The bank of lamps 67 simulate the length of turbulence pattern in the rotating drum at the input end resulting from the input flow rate of the clinkers and thus is a flow related response.

Note that the basic calculations and display indicia are related to the primary criterion, i.e. mill hp. This tells in essence whether the mill is properly loaded for optimum use of the grinding mill, and when raw material input load and/or additives are changed, the motor current reading will establish corresponding slides 66 that show underload or overload conditions, so that the mill operator will know when to change raw material feed, or additive feed, etc. to return to the proper mill load for optimum grinding.

Whenever the density of the clinker or other input materials (31) changes, the tons per hour processed or the volume of materials inside the ball mill 30 accordingly changes. Thus, the optimum loading for efficient grinding will also be a function of density. Thus an indication of density (or void as hereinbefore discussed) can be derived and used in calculations as put into the computer by means of keyboard 9, for example, at density 70 input station (FIG. 1).

The computer can therefore be programmed to change the turbulence pattern displayed on bank of lamps 67 as a function of density and/or the loading pattern 66 to correspond to mill reaction to materials of different densities. Typically the different density inside the mill of input materials and clinkers while being ground will cause a relative shift of the lamp array right or left with respect to the simultaneous display of the optimum internal mill profile 66 and the appearance of the optimum turbulence pattern indicated by lighting of lamp bank 67, central lamp 69 and those lamps to the left thereof.

It is to be understood that the keyboard 9 and computer 10 provides instrumentation capable of different kinds of control and display programs and functions relating to the mill operating conditions determinable as a function of motor current (HP). Thus, the display functions may be amplified, various input data may be derived from instruments or may be manually entered at keyboard 9, and the computer programmed for various extended calculations of mill operation and control without departing from the invention.

Having therefore improved the state of the art in analysis, display and control of mill operation, those features of novelty believed representative of the nature and spirit of the invention are defined with particularity in the claims.

INDUSTRIAL APPLICATION

A portable universal instrument is provided for monitoring the performance of electrical motor driven jar grinding mills such as ball mills for producing cement. Output video presentations of internal mill profile and operational efficiency are provided for on-line viewing, and historical mill performance is recorded for recall and review.

We claim:

1. Instrumentation for monitoring the operating performance of an electric motor driven grinding mill comprising in combination, means for monitoring and indicating the electric motor current of the mill drive motor as the mill operates, means for calculating from a range of variations of said motor current as an input signal mill operating performance indicia representative of the internal grinding status of the mill and means for displaying the mill grinding status in each of a range of mill loads derived from said performance indicia, so that the mill operating conditions may be adjusted in response to the displayed mill grinding status to operate the mill in a predetermined mill load range.

2. Instrumentation as defined in claim 1 including video display means indicating mill performance by display of pictures simulating the mill grinding conditions.

3. Instrumentation as defined in claim 1 including memory means for recording and playing back a history of the mill motor current, and means for periodically sampling the calculated performance indicia to record therein.

4. Instrumentation as defined in claim 3 including means for identifying each sample by clock time.

5. Instrumentation as defined in claim 4 including display means for identifying the clock time of the last recorded sample.

6. Instrumentation as defined in claim 1 for use with a grinding mill employing chemical grinding additives, including means for indicating the magnitude of additives flowing through the mill.

7. Instrumentation as defined in claim 1 wherein said indicia are displayed on a flow rate monitor normalized by the calculating means to compare the relative real time performance to optimum.

8. Instrumentation as defined in claim 7 wherein said indicia are displayed on two monitors, the first being said flow rate monitor and the second monitor comprising selectable video picture producing means providing from said variations a simulated picture of the mill internal grinding conditions.

9. Instrumentation as defined in claim 1 wherein the means for calculating comprises a programmable digital computer, said means for indicating electric current provide digital signals, and including means providing digital clock timing signals and means operating said computer for periodically addressing and sampling the various digital signals for performing calculations therefrom.

10. Instrumentation as defined in claim 9 including digital tape storage means, digital memory means in said computer, and means programming said computer to transfer digital data between said computer digital memory means and said storage means.

11. Instrumentation as defined in claim 9 including universal type means for indicating electrical motor current for mills of various sizes and capacities, and means for processing the current and flow rate indications as a function of the motor size and capacity of different mills, thereby to monitor with the same instrumentation the performance of various jar mills of different operating parameters.

12. Instrumentation as defined in claim 9 including means providing digital signals representing the addition of chemicals into the mill for improving the grinding efficiency, and means for calculating from the last said signals in said computer further indicia to determine the effect of said chemicals upon the production efficiency of the mill.

13. Instrumentation as defined in claim 1 wherein the motor current monitoring means comprises an a-c transformer coupled to the power line feeding the mill motor, and conversion means coupled to the transformer responsive to current changes in the motor to provide said input signal representative of the grinding status of the load being processed in the mill.

14. Instrumentation as defined in claim 13 including means for converting said signal from said conversion means to a digital indication of load magnitude, and computer means adapted to sample and store said digital indication at periodic intervals.

15. Instrumentation as defined in claim 1 wherein the means for indicating the electric motor current comprises an indicator showing the effect of turbulence in the mill resulting from input materials as a turbulence indication having several ranges, and including means for indicating the density of materials processed in the jar mill, and means for varying the turbulence indication range in response to variations of density.

16. Instrumentation as defined in claim 1 including means for indicating the flow rate of materials through the mill and means interrelating the flow rate and current in calculating the mill grinding condition indicia.

17. Instrumentation as defined in claim 16 wherein the means for indicating the flow rate is calibrated to provide the flow rate in pounds per minute per cubic foot.

18. Instrumentation as defined in claim 16 including means for determining the mill production rate, the volume of void space and the recirculated load portion and calculating therefrom the flow rate indication.

* * * * *